United States Patent [19]

Stauber

[11] 4,432,685

[45] Feb. 21, 1984

[54] APPARATUS FOR FORMING STACKS FROM CONTINUOUSLY ARRIVING FLAT PRODUCTS, ESPECIALLY PRINTED PRODUCTS, PARTICULARLY THOSE ARRIVING IN A LAPPED OR IMBRICATED STREAM

[75] Inventor: Hans-Ulrich Stauber, Grüt, Switzerland

[73] Assignee: Ferag AG, Hinwil, Switzerland

[21] Appl. No.: 287,480

[22] Filed: Jul. 27, 1981

[30] Foreign Application Priority Data

Aug. 15, 1980 [CH] Switzerland ..... 6160/80

[51] Int. Cl.[3] ..... B65G 57/30

[52] U.S. Cl. ..... 414/31; 414/47; 414/96

[58] Field of Search ..... 414/31, 43, 47, 92, 414/96

[56] References Cited

U.S. PATENT DOCUMENTS

| | | | |
|---|---|---|---|
| 3,115,090 | 12/1963 | Elander | 414/31 X |
| 3,456,423 | 7/1969 | Helms | 414/31 X |
| 3,566,757 | 3/1971 | Fujishiro | 414/31 X |
| 3,568,578 | 3/1971 | Fujishiro | 414/31 |
| 3,765,546 | 10/1973 | Westerling | 414/96 |
| 4,015,724 | 4/1977 | Spencer | 414/31 |

FOREIGN PATENT DOCUMENTS

| | | |
|---|---|---|
| 599088 | 3/1948 | United Kingdom . |
| 1281757 | 12/1972 | United Kingdom . |
| 1,389,641 | 4/1975 | United Kingdom . |

*Primary Examiner*—Robert J. Spar
*Assistant Examiner*—Ken Muncy
*Attorney, Agent, or Firm*—Werner W. Kleeman

[57] ABSTRACT

Below a stationary stacker device are prestackers movable out-of-phase between receiving and delivery positions. Within a stacker chute of the prestacker located in the receiving position a partial stack is formed from incoming printed products and reposes upon a displaceable support table. In the delivery position, by raising the support table, the partial stack on the support table is displaced into the stacker chute which is closed at its bottom by pivotable restraining flaps. The flaps are pivoted out of their effective position by the introduced partial stack. The flaps are elevationally displaceable and receive the partial stack to be introduced from the support table located in its upper terminal position and, during their displacement movement, convey the engaged partial stack completely into the stacker chute. Both of the prestackers are arranged upon a rotatable support arm. The one prestacker is fixedly connected with the support arm, the other prestacker is rotatably mounted in the support arm. A sprocket wheel is connected with this rotatable prestacker. The sprocket wheel is drivingly connected by a chain with a second sprocket wheel keyed to a pivot pin. Upon rotation of the support arm through 180° the prestacker fixedly connected with the support arm rotates about the pivot pin, whereas the rotatable prestacker rotates about its vertical axis, and thus, performs a translational movement between the receiving and delivery position. Thus, the partial stacks are mutually stacked cross-wise with respect to the final stack.

18 Claims, 13 Drawing Figures

APPARATUS FOR FORMING STACKS FROM CONTINUOUSLY ARRIVING FLAT PRODUCTS, ESPECIALLY PRINTED PRODUCTS, PARTICULARLY THOSE ARRIVING IN A LAPPED OR IMBRICATED STREAM

BACKGROUND OF THE INVENTION

The present invention relates to a new and improved construction of apparatus for forming stacks from continuously infed substantially flat products, especially printed products, and particularly printed products arriving in an imbricated or lapped product stream.

Generally speaking, the stacker apparatus of the present development is manifested by the features that it contains a prestacker device for forming partial stacks and a stackerdevice, in the stacker chute of which the partial stacks reposing upon a support arranged below the stacker chute can be stacked into a final stack. Additionally, there is provided a retention or restraining device which is movable relative to the support. The retention device can be brought into an effective or operative position, where it engages beneath the partial stack, after there has been accomplished the relative movement past the partial stack which is to be engaged.

There are already known to the art different constructions of product stacking equipment, for instance as exemplified in U.S. Pat. No. 4,068,567 and U.S. Pat. No. 4,229,134.

According to one specific construction of prior art equipment of this type, as disclosed in U.S. Pat. No. 3,115,090, the arriving products are stacked into partial stacks in a prestacker unit closed at its bottom end by a grate. The finished partial stacks are permitted to drop, by retracting the grate, onto a stationary support table located below the finished partial stack. For each second partial stack there is accomplished a rotation of the support table through 180° about a vertical axis. Thereafter, the partial stack is shifted by means of a pusher in horizontal direction away from the support table onto an elevationally displaceable stacker table which is located below the one stacker chute of a stacker device. This stacker device possesses two rotatable, stacker chutes which are situated opposite one another with respect to a vertical axis of rotation and can be rotated about such axis of rotation. The stacker chutes can be shifted out-of-phase from a stacker station to a pressing and tying station. By raising the stacker table the partial stacks are displaced from below into the stacker chute located at the stacker station. Each stacker chute is closed towards the bottom by pivotable support elements which can be pivoted by the partial stack introduced into the stacker chute and, after there has been completed the insertion of the partial stack, these support elements can assume their operative or effective position in which they engage below and support the final stack located in the stacker chute. After completion of the final stacking operation the filled stacker chute is brought into the pressing and tying station by carrying out a rotational movement, whereas the other previously emptied stacker chute is rotated into the stacker station. When handling certain types of products, for instance folded printed products, the free fall of the partial stack from the prestacker unit onto the therebelow situated support table and/or the horizontal displacement of the partial stack from the support table to the stacker table can cause a disturbance in the stacked formation due to positional shifting of individual printed products within the partial stack or can lead to damage of individual products.

Since each partial stack must be initially moved from the prestacker unit to the support table, and thereafter must be moved from the support table to the stacker table before it can be displaced into a stacker chute of the stacker device or unit, any increase in the working speed of the apparatus is subject to certain limitations. Additionally, the synchronization of the different movements requires that there be provided a correspondingly complicated control.

SUMMARY OF THE INVENTION

Therefore, with the foregoing in mind it is a primary object of the present invention to provide a new and improved construction of product stacker apparatus which is not associated with the aforementioned drawbacks and limitations of the prior art constructions.

Another and more specific object of the present invention aims at providing an efficient apparatus of the previously mentioned type which is of relatively simple construction and design, and enables the formation of faultless stacks while simultaneously protectively handling the articles or products which are processed.

Still a further significant object of the present invention aims at providing a new and improved construction of product stacker apparatus of the character described, especially for handling products which arrive in a lapped or imbricated stream, which apparatus is relatively simple in construction and design, extremely reliable and efficient in operation, allowing for high stacking speeds, not readily subject to breakdown or malfunction, requires a minimum of maintenance and servicing, and yet is economical to fabricate and quite simple to use.

Now in order to implement these and still further objects of the invention, which will become more readily apparent as the description proceeds, the product stacker apparatus of the present development is manifested by the features that the prestacker device contains two stacker or prestacker units which are movable out-of-phase between a receiving position and a delivery position located below the stationary stacker device. Each of the prestacker units is provided with a support table which closes from below a stacker chute. The retention device in each case can be elevationally displaced relative to the support table of the prestacker or stacker unit located in the delivery position in order to receive the partial stack.

The presence of two prestacker units which are moved out-of-cycle or out-of-phase between the receiving position, where there is formed partial stacks from the incoming products, and the delivery position where the partial stacks are transferred into the stacker chute of the stacker device, allows for a high work speed of the equipment. Since the partial stacks remain in the prestacker unit until transfer to the stacker device, there is also ensured for protective handling of the products, and there is avoided danger of any disturbance in the formation of the partial stack.

If the support tables of the prestacker units are constructed so that they can be raised and lowered, then in the receiving position the support tables can be brought into their upper terminal or end position at the start of the partial stack formation and such support tables can be lowered as a function of the increase in the stack height, so that the individual products, at most, only must drop in a freefall only through a relatively modest height.

In order to obtain at the final stack a crosswise position of the individual partial stacks, one of the prestacker or stacker units is rotated, during its movement from the receiving position into the delivery position, relative to the other stacker or prestacker unit about the lengthwise axis of its stacker chute through approximately 180°. Consequently, the movement of the prestacker units from the receiving position into the delivery or transfer position can be simultaneously employed in order to rotate the partial stack located in a prestacker unit about its stack axis through an angle of 180°. For this rotation there is therefore not required any special work cycle.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
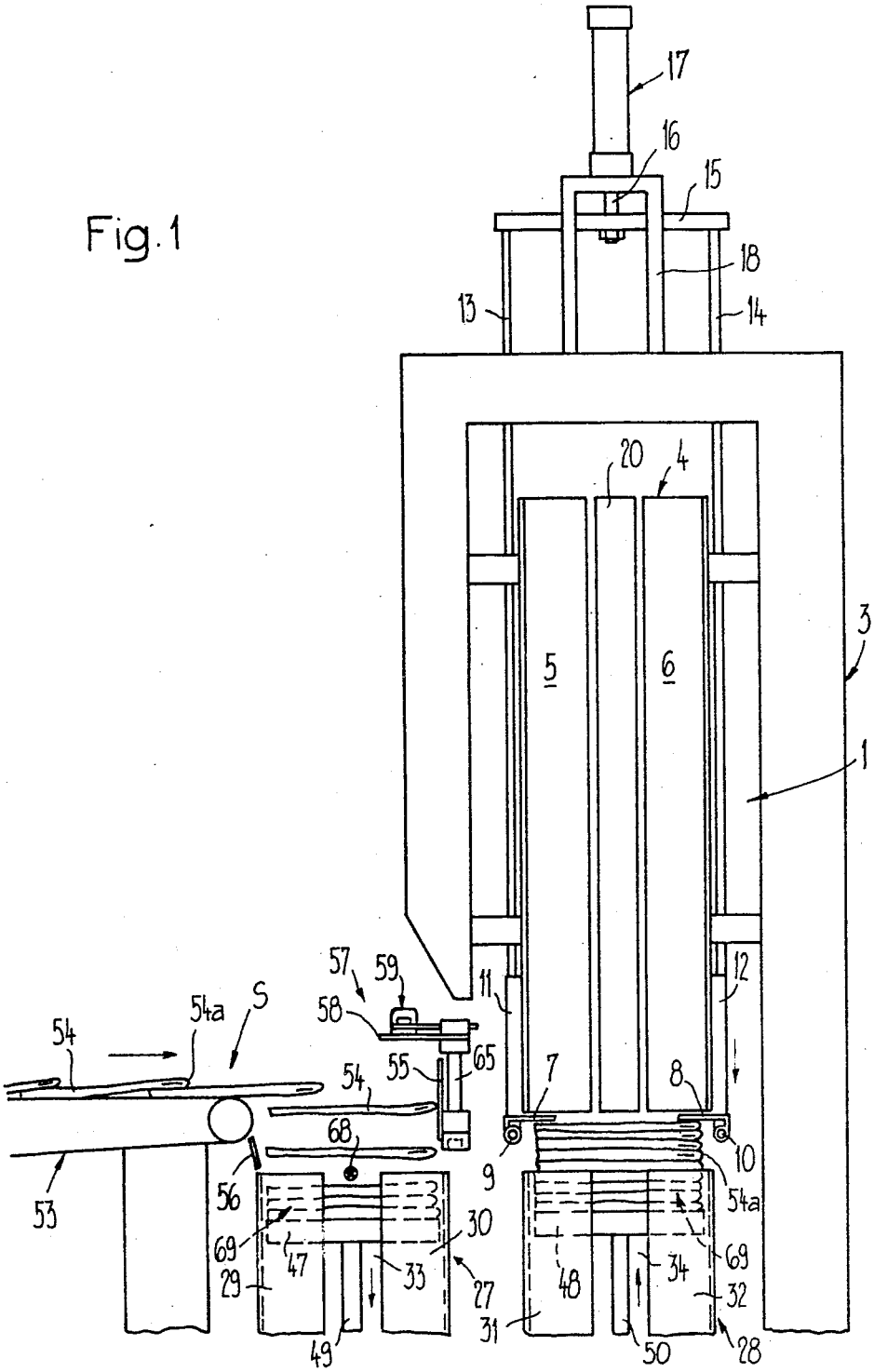
FIGS. 1 and 2 respectively show in schematic side view the upper and lower part of an apparatus for forming crosswise stacks.

Describing now the drawings, the stacker apparatus illustrated in FIGS. 1 to 8*f* by way of example and not limitation will be seen to comprise a stationary stacker device, generally designated by reference character 1, for forming final stacks and a prestacker device 2 arranged forwardly or upstream of such stacker device 1. The stacker device 1 and the prestacker device 2 are housed in a suitable frame or housing arrangement 3 which can be supported upon the floor where the equipment is erected.

The stacker device 1 comprises a stationary stacker chute or shaft 4 which is formed by two oppositely situated, substantially L-shaped side walls 5 and 6. As best seen by referring to FIG. 3, the substantially rectangular-shaped stacker chute 4 is open at a narrow side and possesses at the oppositely situated narrow side a not particularly referenced opening which extends over the entire height. At the lengthwise sides the side walls 5 and 6 are provided at their lower ends with recesses or the like, as the same are particularly well illustrated in FIG. 6 and designated by reference character 6*a*. The purpose of these recesses 6*a* will be explained more fully hereinafter.

Figure 7:
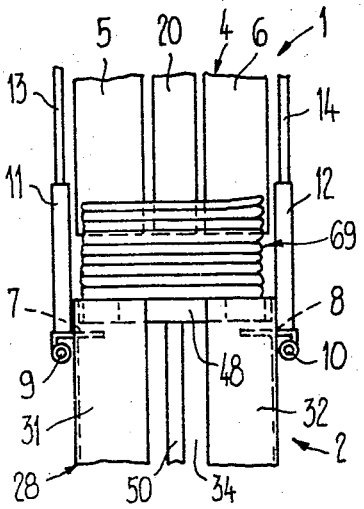
FIG. 7 is an illustration, corresponding to the showing of FIGS. 1 and 2, of the region of transfer of the partial stack from a prestacker unit to the stacker device.

Below the stacker chute 4 there are provided two oppositely situated restraining or retention elements, here shown as restraining flaps 7 and 8 which, when assuming their effective or operative position, protrude into the stacker chute 4, as best seen by referring to FIGS. 1 and 7. These retention flaps or flap members 7 and 8 possess projections 7*a* and 8*a*, as will be recognized by inspecting FIG. 3, which are aligned with the recesses 6*a* at the side walls 5 and 6 and in the effective or operative position of the retention flaps 7 and 8 protrude through such recesses 6*a*. The retention or restraining flaps 7 and 8 are each mounted to be pivotable about a respective pivot shaft 9 and 10 which extends in horizontal direction. Both of the pivot axes or shafts 9 and 10 extend substantially in parallelism to one another and are each retained in a related holder bracket 11 and 12, respectively, the construction of which will be apparent from the showing of FIG. 6. Each holder bracket 11 and 12 is affixed to the lower end of a rod 13 and 14, respectively, which is fixedly connected at its upper end with a plate member 15. The piston rod 16 of a pneumatic or hydraulic cylinder-and-piston unit 17 engages with this plate member 15. The fluid-actuated cylinder-and-piston unit 17 is secured to a holder device 16 which is connected with the frame 3 or the like, as best seen by reverting to FIG. 1. By operating the cylinder-and-piston unit 17 it is possible to raise and lower, as the case may be, the rods or rod members 13 and 14 and along therewith the retention flaps 7 and 8, as such will still further be explained.

Figure 3:
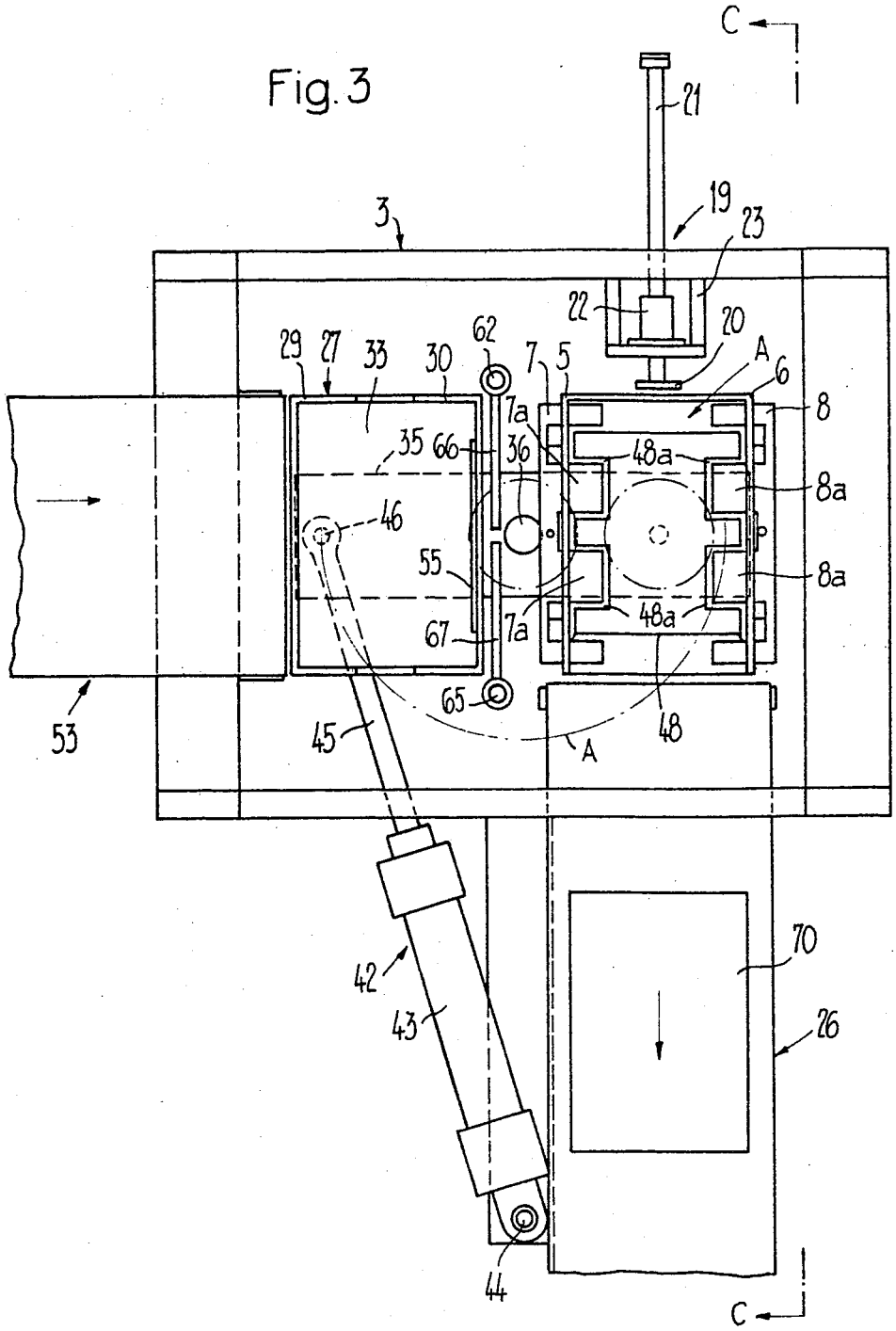
FIG. 3 illustrates the apparatus according to FIGS. 1 and 2 in plan view, wherein however the upper part of the housing frame and the displacement device for the retention elements in the form of retention or restraining flaps has been omitted to preserve clarity in illustration.
Figure 4:
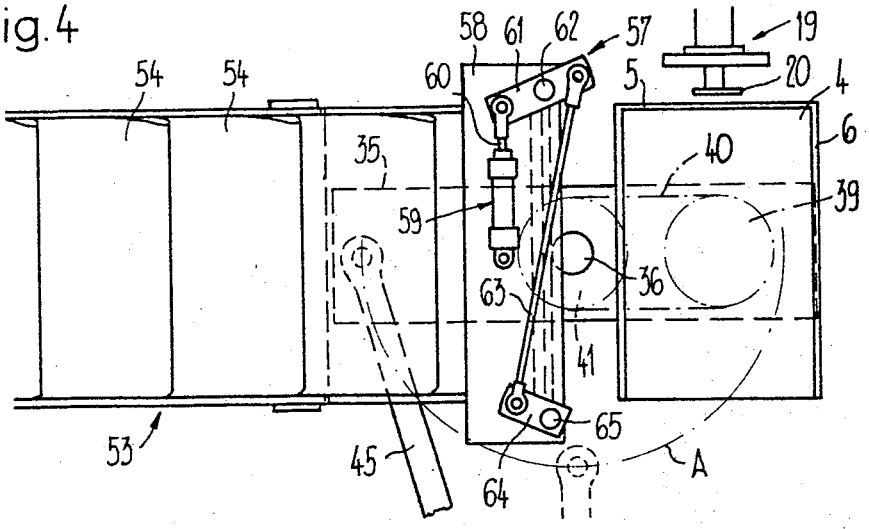
FIG. 4 is a sectional view taken substantially along the line A—A of the arrangement of FIG. 2.
Figure 6:
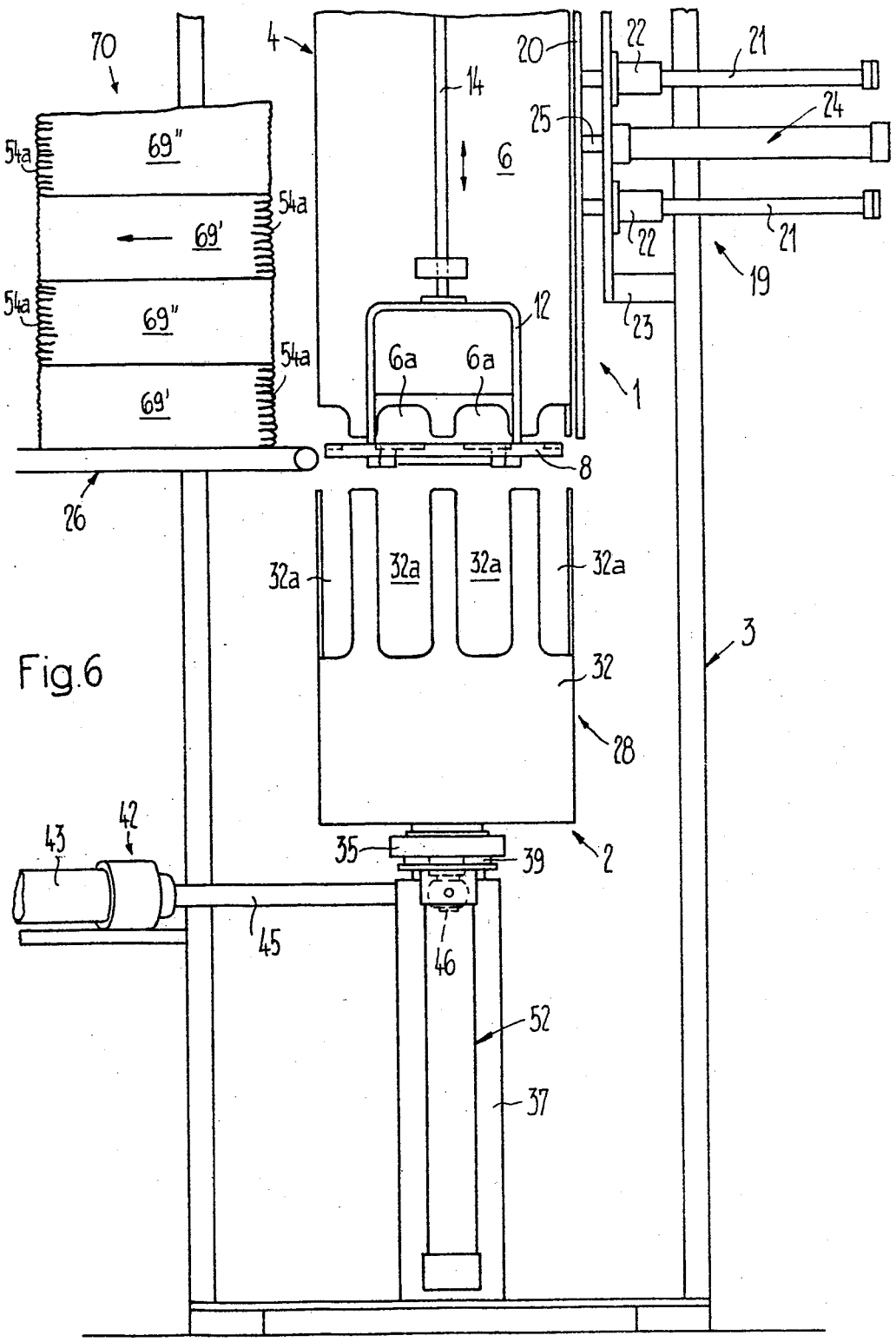
FIG. 6 is a sectional view taken substantially along the line C—C of FIG. 3.

At the narrow side situated opposite the open side of the stacker chute 4 there is arranged an ejector device 19, as will be particularly evident by inspecting FIGS. 3, 4 and 6. This ejector or ejection device 19 possesses a push or impact plate 20 which can be inserted between the side walls 5 and 6 into the interior of the stacker chute 4. As illustrated in FIG. 6, guide rods 21 are connected with the push or impact plate 20. These guide rods 21 travel in guide bushings 22 which are arranged at a holder device 23 fixedly connected with the frame 3. In order to horizontally shift the push or pusher plate 20 there is provided a fluid-operated, here a pneumatic or hydraulic cylinder-and-piston unit 24, the piston rod 25 of which engages with the pusher plate 20. At the open narrow side of the stacker or stack chute 4 there merges a belt or band conveyor 26 serving for the outfeed of the finished final stack (FIGS. 3 and 6).

The prestacker device 2 possesses two prestacker units or prestacker means 27 and 28, each of which is formed by two oppositely located, substantially U-shaped side walls 29 and 30 and 31 and 32, respectively. The upright side walls 29, 30 and 31, 32 define a related stacker chute 33 and 34, respectively. At their lengthwise sides the side walls 29, 30, 31 and 32 are provided at their upper end with recesses, which have been particularly well shown in FIG. 6 and identified by reference character 32*a*. These recesses 32*a* are aligned with the projections 7*a* and 8*a* of the retention or restraining flaps 7 and 8. In the effective or operative position of the restraining flaps 7 and 8 their projections 7*a* and 8*a* can engage into such recesses 32*a* at the side walls 29, 30, 31, 32, as such will be explained more fully hereinafter.

Both of the prestacker or stacker units 27 and 28 are supported by a support or carrier arm 35. This support arm 35 is pivotably mounted upon a bearing pin 36. This upright positioned bearing pin 36 is supported upon a support member 37 which is attached at the frame 3. The prestacker unit 27 is fixedly connected with the support arm 35, whereas the other prestacker unit 28 is rotatably mounted in a bearing bushing 38 or equivalent structure retained in the support or carrier arm 35. This rotatable prestacker or stacker unit 28 is provided with a sprocket wheel 39 which is fixedly connected therewith. Sprocket wheel 39 is rigidly connected for rotation by means of a chain 40 with a sprocket wheel 41 which is keyed or otherwise appropriately fastened to the bearing or pivot pin 36. As will be described more fully hereinafter, during pivoting of the support or carrier arm 35 the stacker or prestacker unit 28 is rotated about its lengthwise axis. This rotation of the prestacker unit 28 is caused by the rotating drive of the sprocket wheel 39 which simultaneously also rotates about its own axis, during revolving about the fixed sprocket wheel 41, in the manner of a planetary gearing.

Figure 5:
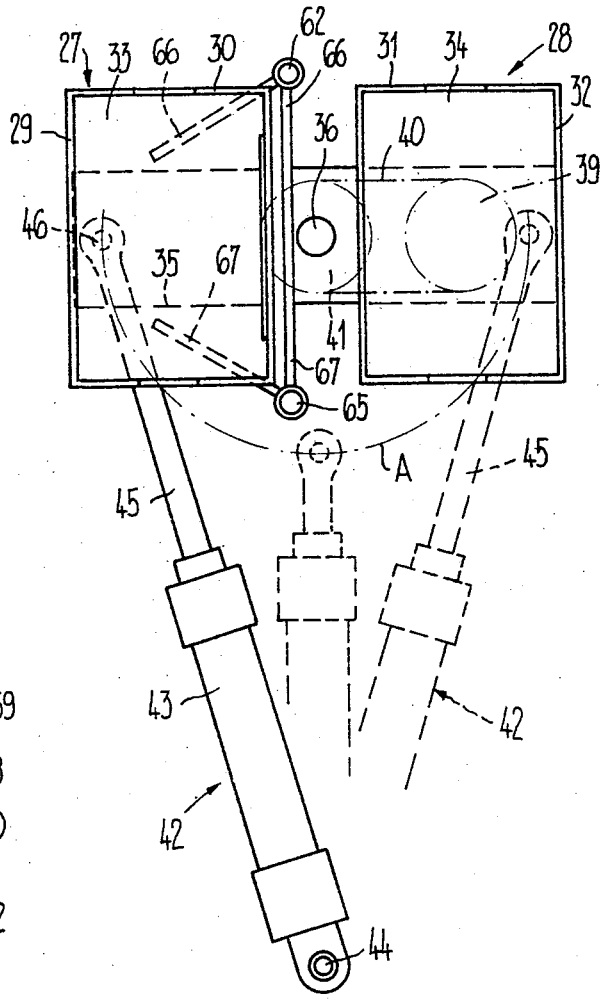
FIG. 5 is a sectional view taken substantially along the line B—B of FIG. 2.

The drive of the support arm 35 is accomplished by means of a pneumatic or hydraulic cylinder-and-piston unit 42. The cylinder 43 of such piston-and-cylinder unit 42 is supported by means of a shaft 44 at the frame 3 and is pivotable about this shaft 44, as will be particularly evident from FIGS. 3 and 5. The piston rod 45 of the cylinder-and-piston unit 42 engages at a connection pin 46 which is attached at the support arm 35. Due to the retraction and subsequent extension of the piston rod 45 the support arm 35 is pivoted about the bearing pin 36 in each case through an angle of 180°. During this pivotal movement of the support or carrier arm 35 the connection pin 46 describes a semi-circular path of movement A (FIGS. 4 and 5).

Each stacker chute 33 and 34 of the prestacker units 27 and 28 is closed at its lower end by an elevationally displaceable, i.e. raisable and lowerable support table 47 and 48, respectively. As will be best seen by referring to the support table 48 illustrated in FIG. 3, each of these support tables 47 and 48 possesses at the lengthwise sides thereof neighbouring the restraining or retention flaps 7 and 8 recesses 48*a*. These recesses 48*a* are aligned with the projections 7*a* and 8*a* of the restraining or retention flaps 7 and 8 and enable table movement past the retention flaps 7 and 8 located in their effective or operative position. Each support table 47 and 48 is carried by a piston rod 49 and 50 of a pneumatic or hydraulic cylinder-and-piston unit 51 and 52, respectively. The cylinder-and-piston unit 51, similar to the related stacker or prestacker unit 27, is fixedly connected with the support arm 35, whereas the other cylinder-and-piston unit 52 is fixedly connected with the second prestacker or stacker unit 28 and is rotatable in conjunction therewith relative to the support arm 35.

The prestacker unit 27 located in the receiving station has arranged upstream or forwardly thereof a belt or band conveyor 53 or equivalent conveyor equipment, which infeeds to the prestacker device 2 the printed products 54 or other articles which are being processed so that they can be stacked. As best seen by referring to FIGS. 1, 2 and 4 the printed products 54 arrive in a lapped or imbricated product formation S, in which the printed products 54 overlap one another in the manner of tiles of a roof. With the illustrated exemplary embodiment the products or articles which are to be processed are constituted by folded printed products 54, which are infed so that a fold edge 54*a* leads. Above the prestacker unit 27 and located opposite the belt conveyor 53 there is arranged an impact plate 55 against which abut the infed printed products 54 at their fold edge 54*a* and thereafter drop downwardly into the stacker chute 33 of the prestacker unit 27. As best seen by referring to FIGS. 1 and 2, a guide plate 56 is located opposite the impact or stop plate 55. This guide plate or plate member 56 serves for the faultless insertion of the printed products 54 into the stacker chute.

Figure 2:
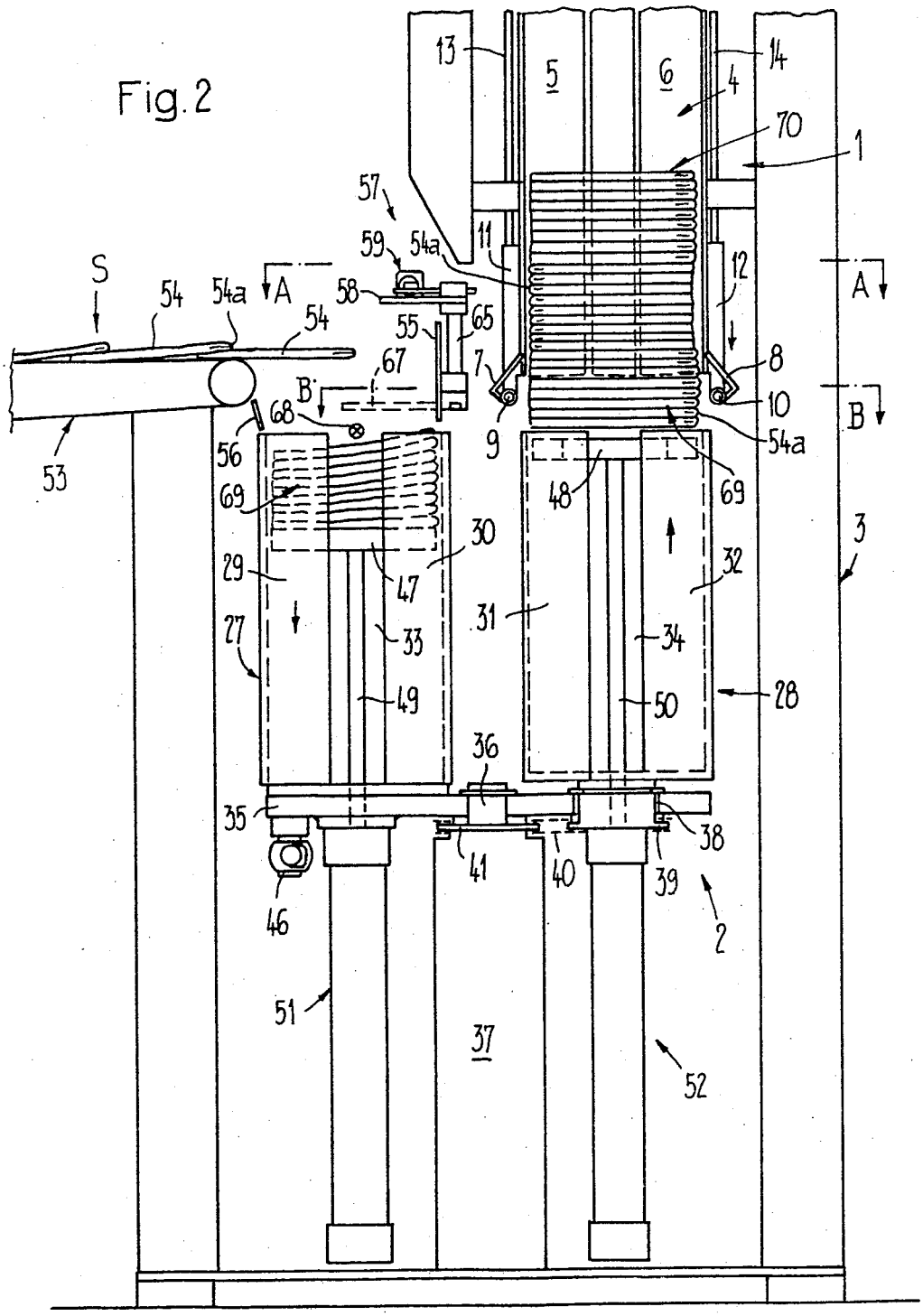

Between the belt or band conveyor 53 and the prestacker unit 27 there is arranged an intermediate stacker device 57, as best seen by referring to FIGS. 1, 2 and 4. This intermediate stacker device 57 comprises a pneumatic or hydraulic cylinder-and-piston unit 59 which is secured to a support plate 58 mounted at the frame 3. The piston rod 60 of the cylinder-and-piston unit 59 engages at one end of a double-arm lever 61 which is rigidly connected for rotation with a vertical shaft 62 (FIG. 4). At the other end of the lever 61 there is attached a connection rod 63 which is connected at its other end with a lever 64 at which there is mounted rigidly for rotation a further shaft 65. At the lower ends of both vertical shafts 62 and 65 there is secured a respective support rod 66 and 67, as will be seen by referring to FIG. 5. In their rest position the support rods or rod members 66 and 67 are located externally of the stacker chute 33, as the same has been illustrated in FIG. 3. By actuating the cylinder-and-piston unit 59 the support rods 66 and 67 are pivoted into their effective or operative position illustrated in phantom lines in FIG. 5, where they protrude into the drop path of the infed printed products 54 and thus cause formation of an intermediate stack. Above the prestacker unit 27 there is arranged a stationary light barrier or photoelectric arrangement 68 or equivalent structure which, in a manner still to be described, serves for controlling the lowering movement of the support table 47.

Having now had the benefit of the description of the stacker apparatus explained in detail above its mode of operation will be considered and is as follows:

During the subsequent description the same will be made with reference to the starting position of both prestacker or stacker units 27 and 28 as shown in the drawings. As illustrated, the prestacker unit 27 is located in the receiving position whereas the other prestacker unit 28 is located in the delivery or transfer position where its stacker chute 34 is aligned with the stacker chute 4 of the stacker device 1. FIG. 2 illustrates a later phase of the equipment operation in relation to the showing of FIG. 1.

At the start of the prestacking operation the support table 47 of the prestacker unit 27 is located in its upper terminal position, which corresponds to the terminal position of the support table 48 of the other prestacker unit 28 as illustrated in FIG. 2. The printed products 54 infed by the infeed conveyor 53 drop, after departing from the infeed conveyor 53 into the stacker chute or shaft 33 of the prestacker unit 27 and come to lie at the support table 47 or, as the case may be, upon the uppermost printed product of the partial stack 69 which is being formed upon such support table 47, as the same has been shown in FIGS. 1 and 2. The support rods 66 and 67 of the intermediate stacker device 57 are located in their rest position and thus do not hinder the freefall of the printed products 54. By means of the light barrier 68 it is possible through actuation of the cylinder-and-piston unit 51 to appropriately lower the support table 47 in accordance with the increasing height of the partial stack 69. Due to this gradual lowering of the support table 47 there is essentially maintained constant the drop height of the printed products 54 departing from the belt or band conveyor 53. In order to prevent that the printed products 54, departing from the belt conveyor 53, must drop in a freefall over too great a drop or fall path, this drop height is reduced to a minimum and, with the exemplary embodiment under discussion, at most amounts to about 10 centimeters.

During such time as there is formed in the receiving station in the stacker chute 33 of the prestacker or stacker unit 27, as described, a partial stack 69 there is displaced at the delivery station the partial stack 69, located in the stacker chute 34 of the other stacker or prestacker unit 28, from below into the stacker chute 4 of the stacker device 1. This is accomplished by raising the stacker or stacking table 48 by the action of the cylinder-and-piston unit 52. Due to the partial stack 69 having been inserted in the described manner into the stacker chute 4, as the same has been illustrated in FIG. 2, both of the restraining or retention flaps 7 and 8 are forced back out of their effective position, i.e. are pivoted by the partial stack moving past such retention or restraining flaps 7 and 8 about their pivot shafts 9 and 10, respectively, so that there is not hindered the pushing of the partial stack 69 into the stacker chute 4. If the support table 48 has reached its upper terminal position, shown in FIG. 2, then by actuating the cylinder-and-piston unit 17 the retention or restraining flaps 7 and 8 are lowered, until they assume their lower terminal or end position as illustrated in FIG. 7, where they are located below the support table 48. As soon as the restraining flaps 7 and 8 have moved past the partial stack 69 then they are pivoted back into their effective or operative position by the action of their own weight or that of a suitable spring or equivalent structure. Now the restraining or retention flaps 7 and 8 are again raised, so that their projections 7*a* and 8*a* can pass through the recesses 48*a* at the support table 48 (FIG. 3) and engage at the lowermost printed product of the partial stack 69 reposing upon the support table 48. During further raising of the restraining flaps 7 and 8 this partial stack 69 is lifted from the support table 48 and is completely inserted into the stacker chute 4. In their upper terminal position, as the same has been illustrated in FIG. 1, the restraining or retention flaps 7 and 8 close towards the bottom the stacker chute 4 and serve as support means for the final or terminal stack 70 located in the stacker chute 4.

As soon as a predetermined number of printed products 54 bears upon the support table 47 of the prestacker unit 27, which can be ascertained in conventional manner, for instance, by appropriately counting the individual printed products 54, then the intermediate stacker device 57 is actuated. The piston rod 60 of the cylinder-and-piston unit 59 is extended, whereby the support rods 66 and 67 are pivoted into their effective or operative position where they extend over the stacker chute 33, as the same has been shown in phantom or broken lines in FIG. 5. The printed products 54 infed by the belt conveyor 53 are now intermediately stacked upon such support rods 66 and 67. Now there is accomplished a pivoting of the support or carrier arm 35 about the bearing pin 36 by actuating the cylinder-and-piston unit 42. Consequently, the prestacker unit 27 along with the finished partial stack 69 is brought from the receiving or receiver station into the delivery or transfer station, whereas the emptied prestacker unit 28 is rotated into the receiver station. As soon as the prestacker unit 28 has reached this receiving position, then, by actuating the cylinder-and-piston unit 59 the support rods 66 and 67 again are pivoted back into their rest position, so that the intermediate stack which has previously been formed on such support rods 66 and 67 drops onto the support table 48. Now there is accomplished in the already described manner, within the stacker chute 34 of the prestacker unit 28, the formation of a partial stack, whereas at the same time the partial stack 69 is moved out of the stacker chute 33 of the prestacker unit 27 and into the stacker chute 4 of the stacker device 1. During the movement of the prestacker unit 28 from the delivery station into the receiver station the support table 48 remains in its upper terminal position, so that upon reaching the receiving position it is ready for receiving the intermediate stack without there being needed any elevational repositioning of the support table 48.

Figure 8A:
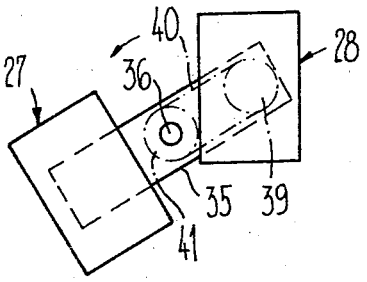
FIGS. 8*a* to 8*f* are respective top plan views of the prestacker units during different movement phases thereof.
Figure 8B:
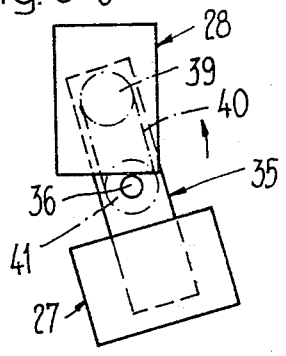
Figure 8C:
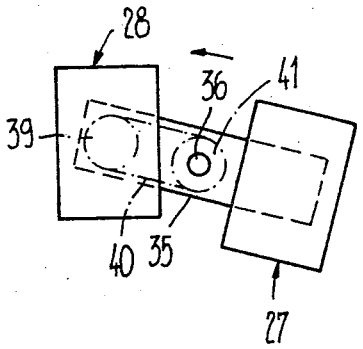
Figure 8D:
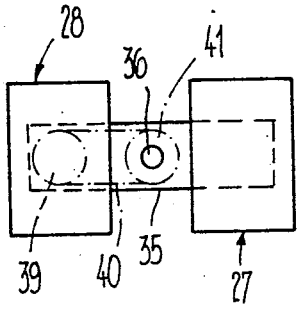
Figure 8E:
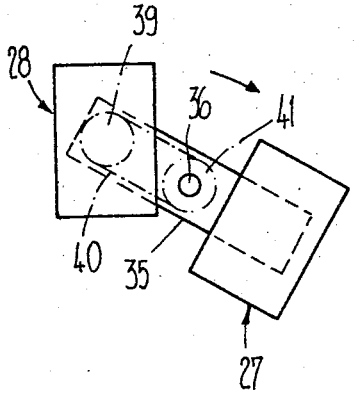
Figure 8F:
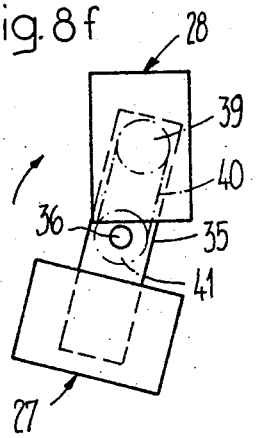

Now based upon the showing of FIGS. 8*a* to 8*f* there will be described the movements which occur during a change in position of the stacker or prestacker units 27 and 28. Starting with the illustration of FIG. 8*a* the FIGS. 8*a* to 8*f* depict different phases during the pivotal movement of the support or carrier arm 35. FIG. 8*a* illustrates the situation which prevails shortly after the prestacking units 27 and 28 have departed from the receiving position and the delivery position, respectively, whereas FIG. 8*d* illustrates the prestacker unit 28 in the receiving position and the prestacker unit 27 in the delivery or transfer position. FIGS. 8*e* and 8*f* show two conditions during the renewed pivoting of the support or carrier arm 35, during which the prestacker unit 28 is moved from the receiving position again into the delivery position. As will be clearly apparent from the illustration of FIGS. 8*a* to 8*f*, the prestacker unit 27 which is fixedly connected with the support arm 35 rotates about the bearing pin 36. This causes a rotation of the stacker chute 33 of the prestacker unit 27 through 180°. This means that the partial stack 69 present in the stacker chute 33 of this prestacker unit 27 likewise rotates through 180° about its lengthwise axis. In contrast thereto the other prestacker unit 28, during the pivoting of the support or carrier arm 35, performs a translational movement along an arc-shaped path. The pivoting of the support arm 35 causes, by means of the chain 40 and the sprocket wheel or gear 39, a corresponding rotation of the prestacker unit 28 relative to the support arm 35. This means that the partial stack located in the stacker chute of the prestacker unit 28 does not experience any rotation about its lengthwise axis during the pivoting of the support or carrier arm 35. In this way there is now achieved the result that within the stacker chute 4 of the stacker device 1 there can be formed from the individual partial stacks 69 a crosswise stacking or crosswise stacked position of the partial stacks 69, as the same has been illustrated in FIG. 2. As to this FIG. 2 this means that in those partial stacks 69, which have been formed in the prestacker unit 28, the fold edges 54*a* of the printed products 54 come to lie at the right side of the final or finished stack 70, whereas the fold edges 54*a* of the printed products 54 of those partial stacks 69 which have been formed in the other prestacker unit 27 are located at the left side of the final stack 70. Due to this crosswise positioning of the partial stacks 69 there is formed, as is well known in this technology, a stable final stack 70 which does not tend to fall over, although the partial stacks 69 at that side where the fold edges 54*a* bear upon one another are higher than at the opposite side. By virtue of the rotation of each second partial stack 69, during the positional change of the prestacker units 27 and 28, there is not needed for such rotation of the partial stacks 69 any special work cycle which, in turn, contributes towards increasing the work or operating speed of the equipment.

As soon as the final or end stack 70 within the stacker chute 4 and formed in the previously described manner has obtained a predestined size, then by actuating the cylinder-and-piston unit 24 there is forwardly thrusted the pusher or impact plate 20 which then moves the final stack 70 reposing upon the retention flaps 7 and 8 out of the stacker chute 4 and onto the belt or band conveyor 26. This belt or band conveyor 26 or equivalent conveyor device serves to transfer the finished final stack 70 to a further processing station, for instance a tying station (FIG. 3). Since the printed products 54 must only freely fall through a relatively low height and the partial stacks 69, during their movement from the receiving station to the delivery station, can remain in the prestacker or stacker units 27 and 28, there is rendered possible with a protective handling of the printed products 54 the formation of a faultless final stack 70.

It should be understood that the described exemplary embodiment of apparatus can be differently constructed in a number of its components or parts. As to these different possible modifications there will be described hereinafter only some of the most important ones.

The support tables 47 and 48 of the prestacker devices 27 and 28 can be constructed to be also stationary instead of elevationally displaceable, i.e. raisable and lowerable. In such instance, the retention or restraining flaps 7 and 8 or equivalent structure must transfer the partial stacks from the support table to the stacker chute 4 of the stacker device 1. In contrast to the described arrangement, with this variant embodiment, the arriving printed products 54 must move, at least at the start of the partial stack formation, through greater distances in a freefall. Under circumstances this can prove to be disadvantageous.

Moreover, it is conceivable, just as was the case for the equipment known to the art from the aforementioned U.S. Pat. No. 3,115,090, to arrange the retention or restraining flaps 7 and 8 so as to be stationary. This means that the support table of the prestacker unit momentarily located in the delivery position must be lifted past the retention flaps 7 and 8, in order to move the partial stack which is to be transferred completely past the retention flaps 7 and 8. This requires a more complicated control of the support tables, since the support tables must be moved between three positions, instead of only between two positions, as is the case for the detailed described exemplary embodiment.

In the event a crosswise position of the partial stacks 69 in the final stack 70 is not required, then both of the prestacker or stacker units 27 and 28 can be fixedly connected with the support or carrier arm 35.

The out-of-phase movement of the prestacker units 27 and 28 between the receiving position and the delivery position can also be accomplished in a manner different than that described. Equally, it is also possible to move the support or carrier arm 35, instead of in opposite directions to-and-fro, in the same direction of rotation or sense by rotating such in each case through 180°.

The drive for rotating the prestacker unit 26 also can be designed differently than that illustrated and herein described.

As to the holder device, which closes at the bottom the stacker chute 4 of the stacker device 1 and serves as the support for the final stack 70, there are also available different constructional designs. Thus, for instance, instead of using both of the oppositely situated retention or restraining flaps 7 and 8 there can be arranged in each corner of the stack chute 4 a restraining or retention element, as the same is known from the previously mentioned U.S. Pat. No. 3,115,090.

Although the illustrated and described intermediate stacker device 57 is designed to be particularly simple and ensures for a faultless intermediate stacking operation, it also can be differently structured. This intermediate stacking device 57 only serves the purpose of accommodating the arriving printed products 54 during the position change of the prestacker units 27 and 28 for such length of time until the empty prestacker or stacker unit again is located in its receiving position. This accommodation or intermediate storing of the printed products 54 and the brief interruption of the arriving printed product stream also can be carried out in any other suitable manner.

It should be understood that the illustrated and described apparatus can be beneficially employed for processing other flat products or articles which are not printed products. These articles or printed products need not arrive necessarily in an imbricated or lapped formation or stream S. Although this apparatus is particularly suitable for forming stacks from printed products having three-folds, its utility is not limited to such type of products.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for forming stacks from continuously arriving, substantially flat products, especially printed products, in particular products arriving in an imbricated product stream, comprising:

a prestacker device for forming partial stacks;

a stacker device having a stacker chute;

support means arranged below said stacker chute of said stacker device;

said stacker device serving for stacking the partial stack reposing upon the support means within the stacker chute of said stacker device into a final stack;

a retention device movable relative to said support means;

said retention device being placeable into an operative position following relative movement of the partial stack which is to be processed past said retention device where said retention device engages below said partial stack;

said prestacker device comprising two out-of-phase operating prestacker units movable between a receiving position and a delivery position located below the stacker device;

a stacker chute provided for each prestacker unit;

a respective support table provided for each prestacker unit for closing towards the bottom the related stacker chute thereof and defining said support means;

means for elevationally displacing said retention device relative to the support table of the prestacker unit located in the delivery position in order to receive the partial stack;

means for raising and lowering the support tables of said prestacker units; and said retention device can be raised and lowered and in a lower terminal position of the partial stack reposing upon a related support table located in its upper end position engages below such partial stack.

2. An apparatus for forming stacks from continuously arriving, substantially flat products, especially printed products, in particular products arriving in an imbricated product stream, comprising:

a stacker device having a stacker chute;

a retention device movable into and out of an operative position;

means for selectively moving the retention device into and out of said operative position;

a prestacker device for forming partial stacks to be formed into a final stack in the stacker chute of the stacker device;

said prestacker device having first and second prestacker units movable in an out-of-phase manner between a receiving position and a delivery position;

each prestacker unit having a stacker chute and a support table for closing the respective stacker chute towards its bottom;

each prestacker unit in its receiving position receiving the arriving products for forming a partial stack in its stacker chute;

each prestacker unit in its delivery position being located below the stacker device with its stacker chute being in alignment with the stacker chute of the stacker device;

the retention device and the support table of the prestacker unit located in the delivery position being relatively movable in a vertical direction to move the retention device and a partial stack of products on said support table of said prestacker unit located in the delivery position past one another, following which the retention device is moved into its operative position where said retention device engages below said partial stack;

means for moving the prestacker units along a semicircular path between the receiving and delivery positions;

said moving means comprise a rotatably driven support element having an axis of rotation;

said rotatably driven support element supporting the prestacker units;

said prestacker units being arranged opposite one another with respect to the axis of rotation of said support element; and at least one prestacker unit being rigidly connected for rotation with said support element.

3. The apparatus as defined in claim 2, further including:

means for rotating one of said prestacker units during its movement from the receiving position into the delivery position about the lengthwise axis of its stacker chute.

4. The apparatus as defined in claim 3, wherein:

said rotating means only rotates said one prestacker unit of said first and second prestacker units about its lengthwise axis, whereas the other prestacker unit does not rotate about its lengthwise axis.

5. The apparatus as defined in claim 4, wherein:

said means for drivingly connecting said gear rigidly connected for rotation with said other prestacker unit with said gear fixedly seated at the axis of rotation of the support element comprises at least one drive element.

6. The apparatus as defined in claim 5, wherein:

said at least one drive element comprises chain means.

7. The apparatus as defined in claim 3, wherein:

said rotating means rotate said one prestacker unit through an angle of approximately 180°.

8. The apparatus as defined in claim 2, further including:

means for rotatably mounting the other prestacker unit about the lengthwise axis of its stacker chute at said support element;

means for rotating the other of said prestacker units during its movement from the receiving position into the delivery position about the lengthwise axis of its stacker chute; and said means for rotating said other prestacker unit comprising gearing means causing rotation of the other prestacker unit during the rotational movement of said support element.

9. The apparatus as defined in claim 8, further including:

a fluid-operated piston-and-cylinder unit engaging with said support element; and said piston-and-cylinder unit selectively pivoting said support element in opposite directions in each case through an angle of approximately 180°.

10. The apparatus as defined in claim 8, wherein:

said gearing means comprise planetary gearing means.

11. The apparatus as defined in claim 8, wherein:

said gearing means comprises a gear rigidly connected for rotation with said other prestacker unit;

a gear fixedly seated at the axis of rotation of said support element; and means for drivingly connecting said gear rigidly connected for rotation with said other prestacker unit with said gear fixedly seated at the axis of rotation of said support element.

12. The apparatus as defined in claim 2, further including:

means for raising and lowering the support tables of said prestacker units.

13. The apparatus as defined in claim 12, wherein:

said retention device can be raised and lowered and in a lower terminal position of the partial stack reposing upon a related support table located in its upper end position engages below such partial stack.

14. The apparatus as defined in claim 2, wherein:

said retention device comprises retention elements which in an effective position thereof protrude into the stacker chute of the stacker device and serve as support means for the received partial stack or the final stack; and the partial stack inserted into the stacker chute of the stacker device moving over such retention elements.

15. The apparatus as defined in claim 14, wherein:

at least one pair of oppositely situated flap-like retention elements is provided; and said flap-like retention elements being pivotable about shaft means extending essentially in parallelism with respect to one another.

16. The apparatus as defined in claim 2, further including:

a receiver station arranged above the prestacker units;

an intermediate stacker device provided at the receiver station; and said intermediate stacker device being capable of activation during the movement of the prestacker units in order to form an intermediate stack from the infed products.

17. The apparatus as defined in claim 16, wherein:

said intermediate stacker device comprises at least one support element for the products; and said at least one support element being insertable into an incoming product stream.

18. An apparatus for forming stacks from continuously arriving, substantially flat products, especially printed products, in particular products arriving in an imbricated product stream, comprising:

a stacker device having a stacker chute;

a retention device movable into and out of an operative position;

means for selectively moving the retention device into and out of said operative position;

a prestacker device for forming partial stacks to be formed into a final stack in the stacker chute of the stacker device;

said prestacker device having first and second prestacker units movable in an out-of-phase manner between a receiving position and a delivery position;

each prestacker unit having a stacker chute and a support table for closing the respective stacker chute towards its bottom;

each prestacker unit in its receiving position receiving the arriving products for forming a partial stack in its stacker chute;

each prestacker unit in its delivery position being located below the stacker device with its stacker chute being in alignment with the stacker chute of the stacker device;

the retention device and the support table of the prestacker unit located in the delivery position being relatively movable in a vertical position to move the retention device and a partial stack of products on said support table of said prestacker unit located in the delivery position past one another, following which the retention device is moved into its operative position where said retention device engages below said partial stack;

means for rotating one of said prestacker units during its movement from the receiving position into the delivery position about the lengthwise axis of its stacker chute; and said rotating means only rotates said one prestacker unit of said first and second prestacker units about its lengthwise axis, whereas the other prestacker unit does not rotate about its lengthwise axis.

* * * * *